US007338067B2

(12) United States Patent
Flaig

(10) Patent No.: US 7,338,067 B2
(45) Date of Patent: Mar. 4, 2008

(54) MAGNETIC METHOD AND APPARATUS FOR INCREASING FOOT TRACTION ON SPORTS BOARDS

(76) Inventor: Theodore J. Flaig, 30351 Pudding Creek Rd., Fort Bragg, CA (US) 95437

( * ) Notice: Subject to any disclaimer, the term of this patent is extended or adjusted under 35 U.S.C. 154(b) by 206 days.

(21) Appl. No.: 11/370,348

(22) Filed: Mar. 7, 2006

(65) Prior Publication Data

US 2006/0197311 A1 Sep. 7, 2006

Related U.S. Application Data

(60) Provisional application No. 60/659,450, filed on Mar. 7, 2005.

(51) Int. Cl.
*A63C 9/00* (2006.01)
*B62B 17/00* (2006.01)
*B63B 35/00* (2006.01)

(52) U.S. Cl. ..... 280/611; 280/612; 280/613; 280/14.22; 441/65; 441/74

(58) Field of Classification Search ..... 280/611, 280/612, 613, 14.22; 441/65, 74
See application file for complete search history.

(56) References Cited

U.S. PATENT DOCUMENTS 2,276,826 A * 3/1942 Crowther ..... 280/612
3,246,907 A * 4/1966 Chisholm ..... 280/612
3,437,345 A * 4/1969 Berta ..... 280/607
3,925,911 A * 12/1975 Erlebach ..... 36/117.4
3,927,897 A * 12/1975 Olson et al. ..... 280/612
3,960,383 A 6/1976 O'Neil
5,954,357 A 9/1999 Golling
6,224,086 B1 * 5/2001 Golling ..... 280/612
6,299,192 B1 10/2001 Bryce
6,863,583 B2 * 3/2005 Takahashi ..... 441/74
7,220,158 B1 * 5/2007 Norris ..... 441/74
2003/0094788 A1 * 5/2003 Jacobs ..... 280/612
2003/0211789 A1 * 11/2003 Taylor ..... 441/74

* cited by examiner

*Primary Examiner*—Christopher P. Ellis
*Assistant Examiner*—John R. Olszewski
(74) *Attorney, Agent, or Firm*—Craig M. Stainbrook; Stainbrook & Stainbrook, LLP

(57) ABSTRACT

A sports board binding and foot traction apparatus for use in sports boards such as surfboard, skateboard, wakeboards, and the like. The apparatus includes a sports board having an upper surface and at least one magnet holding receptable disposed in the upper surface; A a ferromagnetic bar is disposed under the bottom of the magnet holding receptacles, and permanent magnets are placed in the receptacles to form a magnetic region on the surface of the board. An article of sports footwear having a sole is provided, and a ferromagnetic plate is disposed in at lest a portion of the footwear soles. When the footwear is brought into proximity with the magnetic field, a binding force is applied to the footwear.

17 Claims, 4 Drawing Sheets

MAGNETIC METHOD AND APPARATUS FOR INCREASING FOOT TRACTION ON SPORTS BOARDS

CROSS REFERENCES TO RELATED APPLICATIONS

The present application claims the benefit of the filing date of U.S. Provisional Patent Application, Ser. No. 60/659,450, filed Mar. 7, 2005 (Mar. 7, 2005).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to sports boards, such as skateboard, surfboards, snowboards, windsurfing boards, kitesurfing boards, wakeboards, and the like, and more particularly to binding methods and methods of providing foot traction on such boards.

2. Discussion of Related Art Including Information Disclosed Under 37 CFR 1.97 and 37 CFR 1.98

The 2006 Winter Olympics brought a high level of world attention to the growing popularity of board sports. In the case of the Olympic Games, the prominent sport was snow boarding, but with only a little attention to the commentary and interviews with the athletes, it became obvious that the favored off season sport of snow boarders was skateboarding. These sports, along with a rapidly growing number of alternatives to mainstream sports, are coming to be known as extreme sports. They include such things as rock climbing, windsurfing, kite surfing, snowboarding, snow skating, inline skating, roller hockey, women's hockey, skateboarding, motocross racing, freestyle BMX bike riding, technical canyoneering, whitewater kayaking, base jumping, sky surfing, and so on. Indeed, a full embrace of such "thrill" sports appears to be tracking the more general cultural practice of aesthetic self-fashioning, and as that culture matures, a culture in which death is increasingly felt to be remote and unlikely (due to sophisticated medical practices and increased life spans) yet more real and dreadful (due to skepticism and decreased religious belief), brushes with death are all the more compelling. And so it is that youth will even more dramatically push the boundaries of the possible, challenge life (and death) and perform remarkable and beautiful feats in the process.

Interestingly, participants in extreme sports also demand good equipment. Whole industries thrive on providing stronger, lighter, faster, more durable, and better performing gear. This is certainly the case for binding methods for snow boards, windsurfing boards, skis, and the like. Recent contributions to the field of binding methods are far too numerous to list and describe. But a few developments in the field of magnetic binding apparatus are of note.

For instance, U.S. Pat. No. 3,960,383, to O'Neil, teaches a ski-binding system including front and rear coupling units attached a ski and cooperating boot attachments of magnetically sensitive material. Each unit includes magnetics such that when a ski boot provided with the attachments is positioned between the units, the boot is secured by the magnetic attraction between the boot attachments and the magnetic units. As a first instance of magnetic binding methods, the cleverness of the '383 patent is undeniable, but its practical utility is almost entirely restricted to use on skis, as the binding units are bulky, fixed, and work only with relative rigid boots.

U.S. Pat. No. 5,954,357, to Golling, discloses a snow boot and binding system for snow skiing or snow boarding in which only magnetic forces are used to affix the snow boot to the ski or snow-board. The system comprises three components, namely, a support base in ski or snow board, a foot enclosure assembly, and release means connected to the foot enclosure assembly for releasably interconnecting the foot enclosure assembly with the support base. The support base has spaced-apart recesses within which are mounted magnets, either singly or in an array. the foot enclosure comprises a snow boot having metal plates affixed to the lower surface and the back of the snow boot. The release means essentially comprises a lever system for prying the boot off the support base through moving a cam handle. While this system allows for selective placement of the user's feet on the sports board, it entails the use of rigid boots and so is truly suitable only for snow boards, but not for skateboards, surfboards, wakeboards, and other sports boards used with free feet.

U.S. Pat. No. 6,299,192 to Bryce shows a binding apparatus for use with sports boards such as skate boards, which includes two knobs integral with the top of the board and which insert into matching recesses in each of the user's shoes. The knob may include a compression ring or the knob and shoes may include cooperating magnets that hold the two together up to a predetermined breakaway force. The limitation of this method is that the user's feet are fixed at the position of the knobs.

U.S. Pat. No. 6,863,583 to Takahashi, discloses a surfboard having a magnetic region made of permanent magnets, which is, in turn, covered by a foot pad, and to which a surfer is secured through shoes having ferromagnetic material included in the soles. The inventive principles in the '583 patent providing the launch point for the novel improvements of the present invention, in that the '583 patent does not teach or disclose any means for interchanging, adjusting, and selectively removing the magnetic region in the sports board.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is a magnetic sports board binding and foot traction apparatus. In its most essential aspect, the inventive apparatus comprises one or more magnet holding receptacles disposed in the upper surface of a sports board, each receptacle having a ferromagnetic bar disposed in or under at least a portion of the bottom of the receptacle. Permanent magnets are selectively placed into the one or more receptacles and each bind to the ferromagnetic bar, holding them firmly in place even during the most violent of sports activities. The insertion of the magnet(s) into the receptacles thus forms a magnetic region on the surface of the sports board. The sports board user is then provided with footwear having a ferromagnetic plate affixed to, or incorporated into, at least a portion of the sole of the footwear. Accordingly, when the user mounts the sports board and brings his or her foot into proximity with the magnetic region of the sports board, footing and traction are enhanced.

In a preferred embodiment, the magnet holding receptacles are formed in a box, preferably polycarbonate, which may be formed into the sports board at the time of manufacture or placed into a recess cut into the board for a retrofit installation. The box provides magnet holding receptacles in an ordered array according to the kind of footwork anticipated during board use.

In the preferred embodiment, the permanent magnets are cylindrical disks having finger or tool gripping means on their upper surfaces so that they can be easily lowered into and pulled out of the magnet holding receptacles. In this fashion, the magnetic region of the sports board can be precisely tailored to the wants and needs of the user by employing a very specific magnet or combination of magnets that create the desired holding power.

It is therefore an object of the present invention to provide a new and improved sports board binding and foot traction apparatus.

It is another object of the present invention to provide a new and improved sports board binding and foot traction apparatus that employs magnets alone as the binding force.

A further object or feature of the present invention is a new and improved sports board binding and foot traction apparatus that enables a rapid change in the binding force provided by the magnets so that different safety and/or performance requirements can be addressed.

An even further object of the present invention is to provide a novel sports board binding and foot traction apparatus that can be selectively used or eliminated entirely when so desired by the user.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
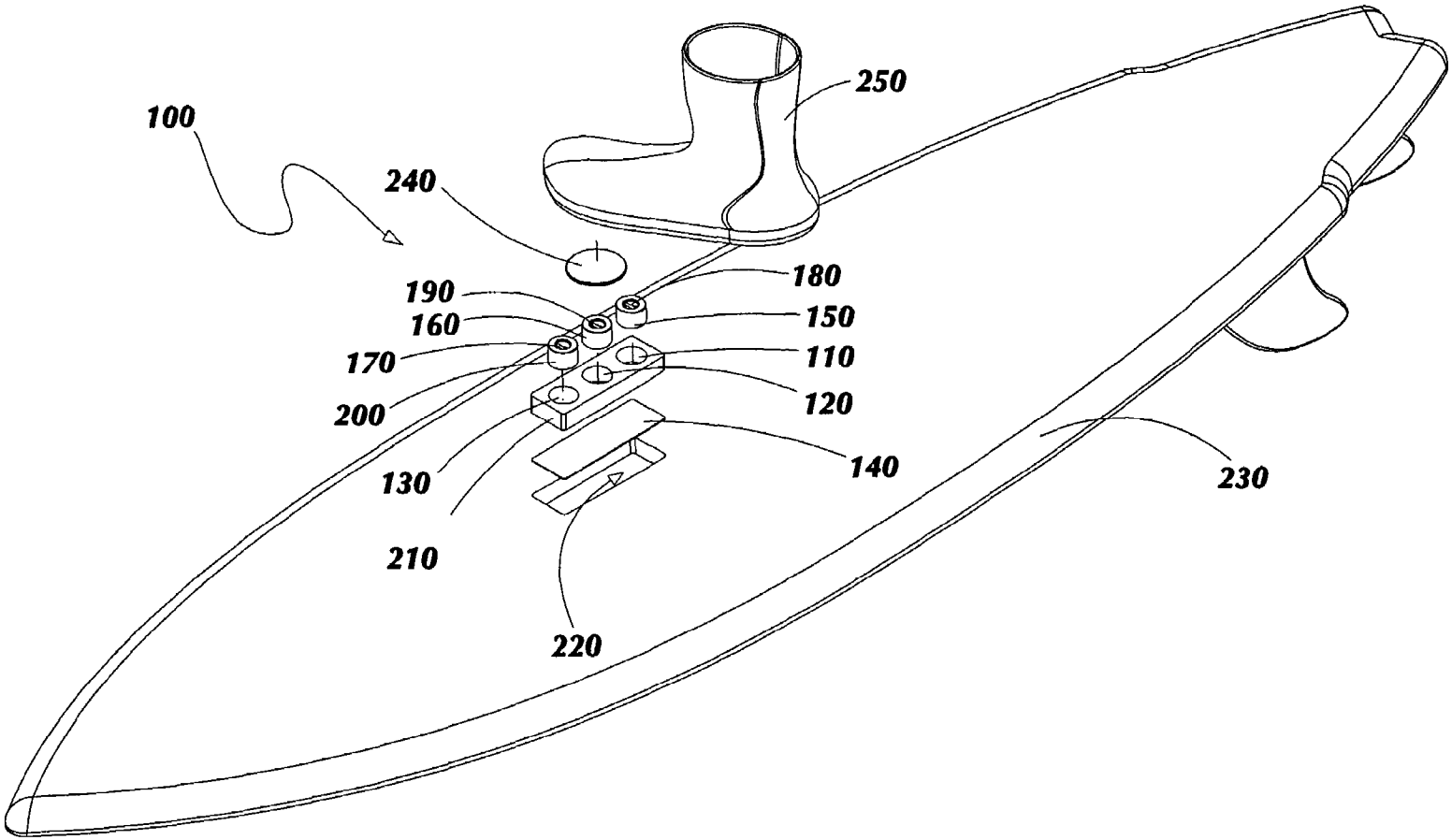
FIG. 1 is a perspective view showing the structural and operational elements comprising the inventive magnetic sports board binding and foot traction apparatus.

Referring to FIGS. 1 through 5, wherein like reference numerals refer to like components in the various views, there is illustrated therein a new and improved magnetic sports board binding foot traction apparatus, generally denominated 100 herein.

Figure 2:
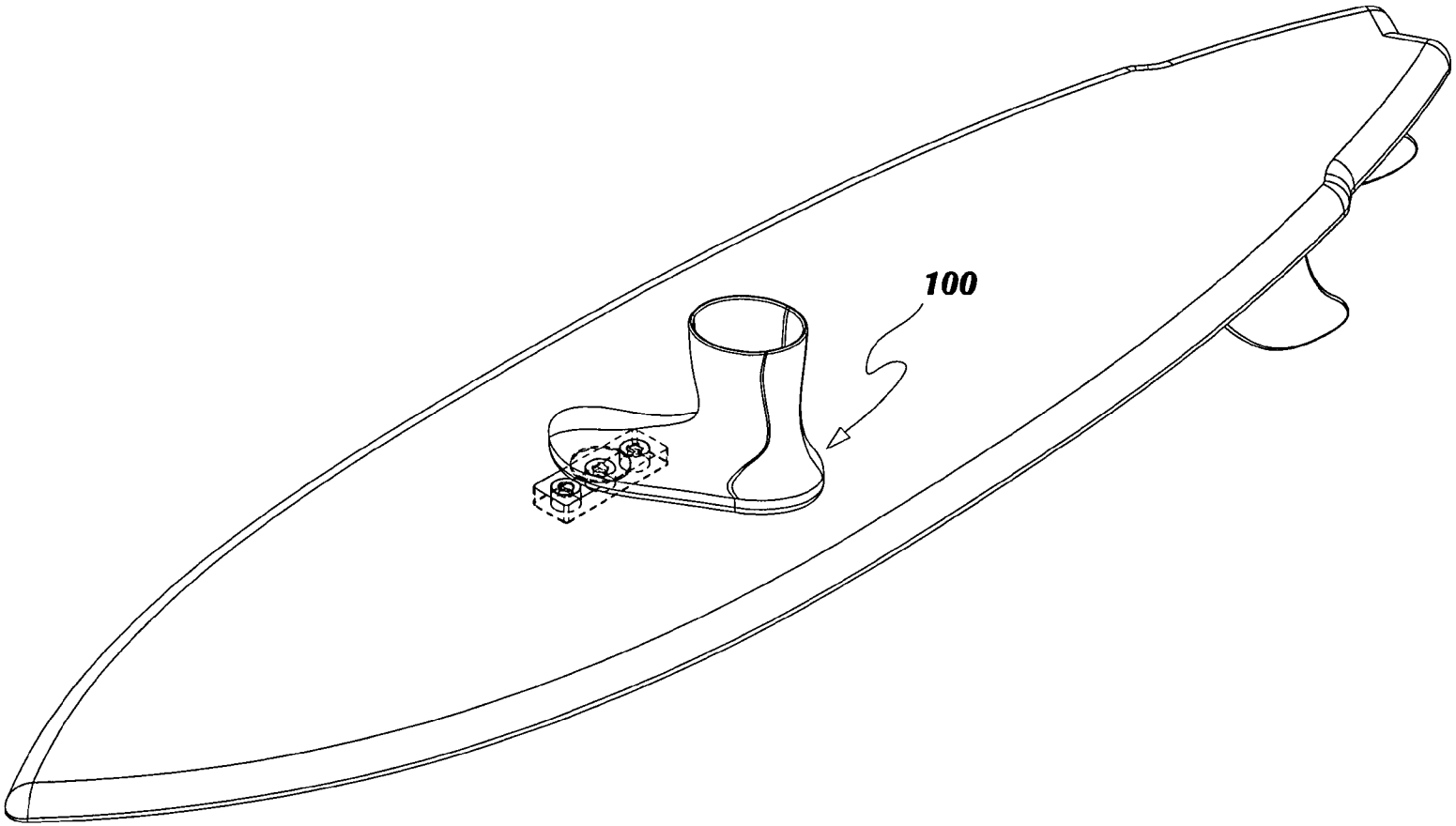
FIG. 2 shows the apparatus of FIG. 1 with footwear placed over the magnetic region of the sports board.

FIGS. 1 and 2 show the inventive apparatus employed for use in a surfboard. These views show that in a first preferred embodiment the binding and foot traction of the present invention comprises one or more magnet holding receptacles 110, 120, 130, disposed in the upper surface of a sports board, in this instance a surfboard. The receptacles may be arranged in a linear array or in any other arrangement suited to the kind of footwork anticipated by the user or common to the sport. The receptacles are open at the top before insertion of magnets and preferably remain open and after insertion. At least a portion of the base or bottom of the receptacles, or the space immediately below the base of the receptacles, includes ferromagnetic material, such as a ferromagnetic bar 140 extending between and under the receptacles. In this manner, the receptacle bottoms provide a member to which magnets may bind.

The next element in the inventive apparatus comprises one or more permanent magnets, 150, 160, 170, which are disposed in the magnet holding receptacles. The magnets are preferably either ceramic (strontium ferrite) magnets, rare earth magnets, or aluminum/nickel/cobalt (Alnico) magnets. Even more preferably, the magnets may be samarium cobalt magnets, nickel plated and unplated neodymium magnets, and/or neodymium-iron-boron magnets. The choice will be largely driven by the desired holding power, the mass of the magnet suitable for use, and costs. No matter what kind of magnet is selected, it is shaped and sized for a close fit insertion into one of the receptacles. A preferred shape, then, of both receptacle and magnet is that of a cylindrical plug, as illustrated. The desired holding power, in turn, will be driven by the weight of the user, the forces encountered during performance, and the degree to which the user wishes to be bound to the board or to be free to move and reposition his or her feet. Indeed, because a user may wish to fine tune the binding power provided in the magnetic region of the board, the magnets are preferably fabricated with grips or handles 180, 190, 200 integrated into or attached to their upper surfaces. These will allow the user to pull the magnets out of the receptacles using either fingers or a simple tool adapted for such use. In the alternative, the upper surface of the magnets can be kept entirely planar so that holding power is not in any respect compromised, and a tool, such as a hand held magnet with an attached handle, or ferromagnetic block having a handle. In either case, the magnet removing tool need only have an attractive force stronger than that of the ferromagnetic material disposed in the magnet holding receptacle, such that upon placing it over a magnet disposed in a receptacle, the magnet will bind to the tool and can then be lifted out of the receptacle. Replacement of magnets does not require the use of any tool. Rather, a new magnet may be dropped into a receptacle using fingers only. In this manner, the presence, the shape, and the strength of the magnetic field produced by the magnets can be nicely fit to the user and his or her demands.

As will be readily appreciated, the magnet holding receptacles may be incorporated into the sports board at the time of manufacture or may be installed as part of a magnet holding box 210 disposed in a cutout 220 formed in an already manufactured board 230.

The next element in the inventive apparatus is a ferromagnetic plate 240 affixed to or incorporated into footwear 250 to be worn by the board user. The footwear may be a wetsuit bootie, a sports sandal, tennis shoe, skate shoe, and the like. Accordingly, the plate may be sewn into the fabric of a wetsuit bootie, molded into the sole of a skate shoe or sports sandal, or otherwise affixed by adhesives, rivets, or other fastening devices. Because of the power of the permanent magnets, the ferromagnetic plate need not be so thick that it interferes with natural foot movement. Preferably it is positioned generally near the ball of the foot, though, again, it may be sized and positioned according to the particular wants and needs of the user.

Figure 3:
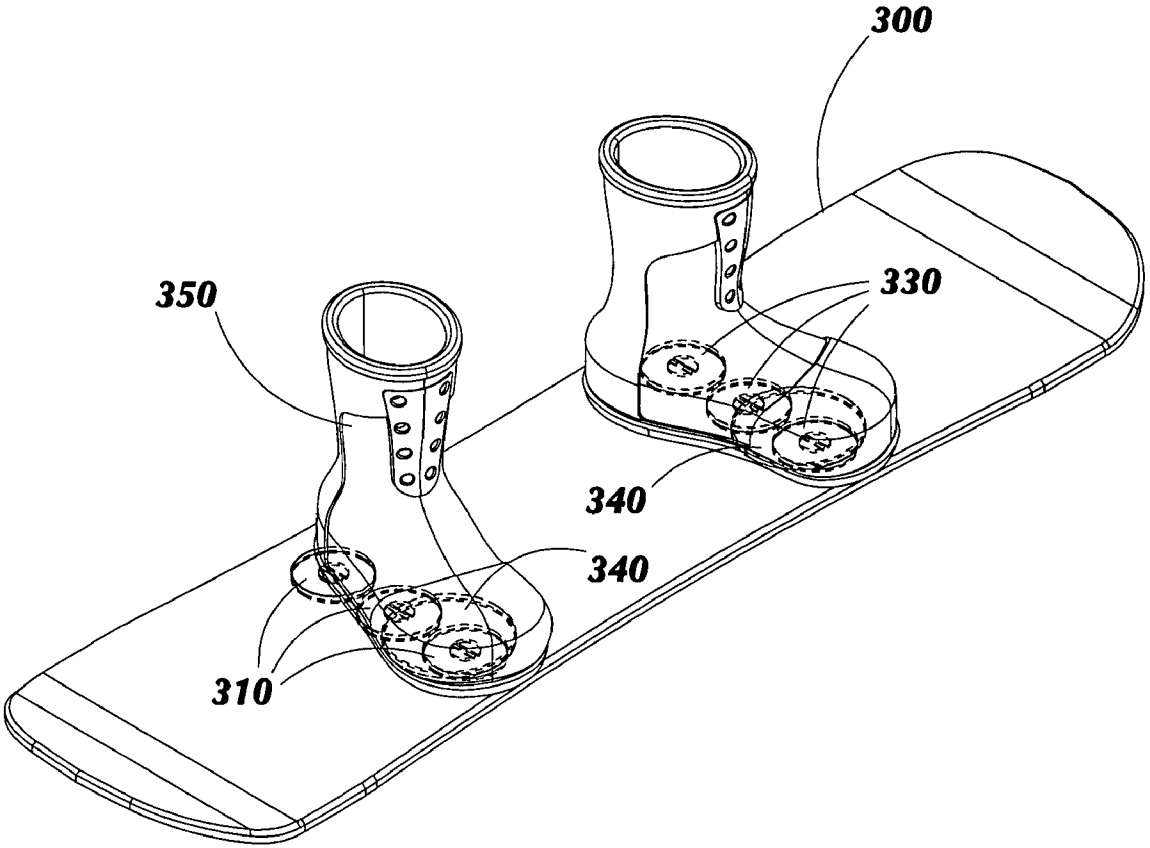
FIG. 3 shows the inventive apparatus adapted for use in a snow board.
Figure 4:
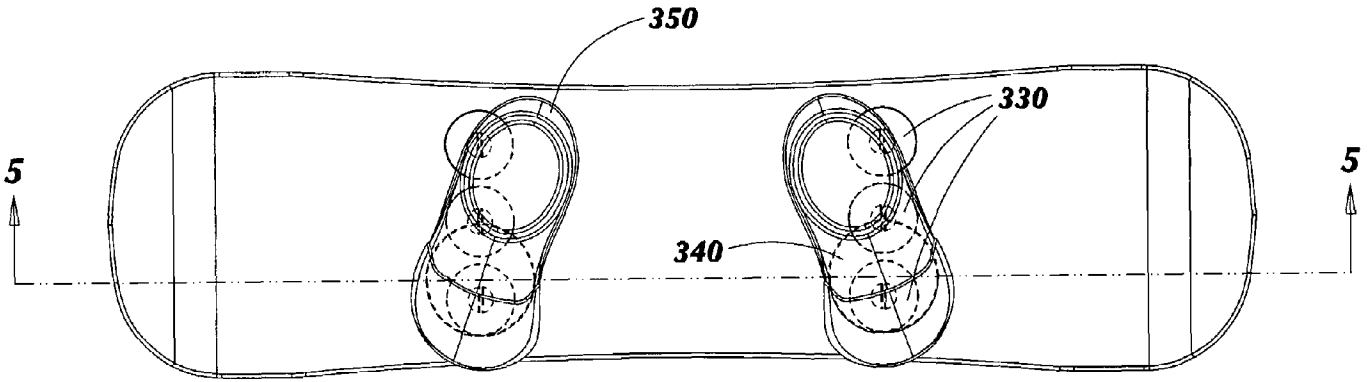
FIG. 4 is a top plan view of the apparatus of FIG. 3, showing the foot plate and cylindrical magnets in phantom.
Figure 5:
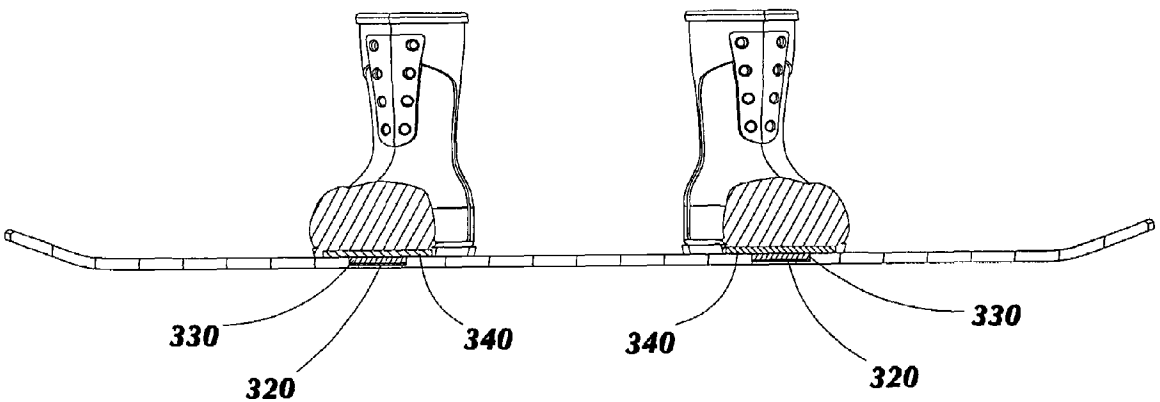
FIG. 5 is a side view in elevation of the apparatus of FIGS. 3 and 4, taken along section line 5-5 of FIG. 4.

FIGS. 3-5 show an alternative embodiment of the inventive apparatus, adapted for use in a snow board 300. The inventive elements and principles are identical to the embodiment shown in FIGS. 1-2, except that the magnet holding receptacles 310 are incorporated into the snow board, as are the ferromagnetic bars 320 at the base of the receptacles. The permanent magnets 330 may be removably installed in the receptacles, and include grips on the upper surfaces for easy swapping and changing. A relatively large ferromagnetic plate 340 is disposed in the sole of the snow board boot 350. As will be understood, the safety and performance requirements for use of the inventive system in a snow board differ dramatically from those for use in a surfboard. In the latter, the user may wish considerable latitude to move his or her feet, and detachment from the board during or after a fall is critical to prevent drowning. By contrast, a snow boarder wants to remain effectively fixed to the top of the snow board and would prefer not to become detached from the board, even during and after falls. Accordingly, the combination of magnets and ferromagnetic plate for use in the snow board may be configured to provide a holding power of several hundred pounds.

In another aspect, the inventive apparatus can be conceived of as a sports board foot traction kit that includes a magnet holding receptacle box having an upper surface with a number of recesses in the upper surface; several permanent magnets (preferably of a variety of holding powers) for selective placement in the recesses; and means for rapid and easy removal and replacement of the magnets from the recesses. This portion of the kit can be installed as a retrofit in a sports board simply by providing a cutout of suitable size in the upper surface of the board. Footwear having ferromagnetic material in the shoe sole can then be provided to cooperate with the magnets to provide traction and binding power.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A sports board binding and foot traction apparatus, comprising:

a sports board having an upper surface for placement of a user's feet during use, said sports board having at least one magnet holding receptacle disposed in said upper surface;

a ferromagnetic bar disposed under the bottom of the at least one magnet holding receptacles;

one or more permanent magnets disposed in at least one of the magnet holding receptacles;

at least one article of sports footwear having a sole; and a ferromagnetic plate disposed in a portion of each of said soles.

2. The apparatus of claim 1, wherein each of said permanent magnets has an upper surface and a finger grip or tool grip disposed on said upper surface.

3. The apparatus of claim 1, wherein each of said permanent magnets is selected from the group consisting of ceramic magnets, rare earth magnets, or aluminum/nickel/cobalt magnets, samarium cobalt magnets, nickel plated neodymium magnets, unplated neodymium magnets, and neodymium-iron-boron magnets.

4. The apparatus of claim 1, wherein the magnet holding receptacles are incorporated into the sports board at the time of manufacture.

5. The apparatus of claim 1, further including a magnet holding receptacle box, wherein all of the magnet holding receptacles are disposed in said magnet holding receptacle box, and wherein said sports board includes a cutout in said upper surface into which said magnet holding receptacle box is disposed.

6. The apparatus of claim 5, wherein said magnet holding receptacle box is fabricated from a plastic.

7. The apparatus of claim 6, wherein said plastic is polycarbonate.

8. The apparatus of claim 5, wherein the cutout has a bottom and said ferromagnetic bar is interposed between said magnet holding receptacle box and said bottom.

9. The apparatus of claim 1, wherein said sports board is selected from the group consisting of surfboard, skateboard, snowboard, windsurfing board, windsailing board, and kite-surfing board.

10. The apparatus of claim 1, wherein said ferromagnetic bar is integrated into said sports board at the time of manufacture.

11. The apparatus of claim 1, wherein said footwear is selected from the group consisting of wetsuit bootie, sports sandal, skate shoe, general athletic shoe, and tennis shoe.

12. The apparatus of claim 1, wherein said footwear is a wetsuit bootie and said ferromagnetic plate is sewn into the sole of said bootie.

13. The apparatus of claim 1, wherein said footwear is selected from the group consisting of sports sandal, skate shoe, general athletic shoe, and tennis shoe, and said ferromagnetic plate is incorporated into the sole of said footwear.

14. The apparatus of claim 1, wherein said footwear is selected from the group consisting of wetsuit bootie, sports sandal, skate shoe, general athletic shoe, and tennis shoe, and wherein said ferromagnetic plate is glued to the sole of said footwear.

15. The apparatus of claim 1, wherein the magnet holding receptacles are arranged in a linear array.

16. A sports board foot traction kit, comprising;

a magnet holding receptacle box having an upper surface and a plurality of recesses in said upper surface;

a plurality of permanent magnets for selective placement in at least one of the recesses in said magnet holding receptacle box, wherein each of said magnets has removal means for rapid and easy removal of said magnet from the recess;

ferromagnetic material disposed proximate each of the recesses for holding said magnet after placement of said magnet in the receess;

an article of athletic footwear, including a shoe sole;

ferromagnetic material disposed in at least a portion of said shoe sole.

17. The kit of claim 16, wherein said pluraility of magnets includes a variety of magnets of varying holding power.

* * * * *